US010495308B2

(12) United States Patent
Pablo Curto et al.

(10) Patent No.: US 10,495,308 B2
(45) Date of Patent: Dec. 3, 2019

(54) SAFETY VALVE

(71) Applicant: ORKLI, S. COOP., Ordizia (ES)

(72) Inventors: Marcos Pablo Curto, Hernani (ES); Andoni Unanue Imaz, Idiazabal (ES); Mikel Zuriarrain Berasategi, Lazkao (ES)

(73) Assignee: ORKLI, S. COOP., Ordizia (ES)

( * ) Notice: Subject to any disclaimer, the term of this patent is extended or adjusted under 35 U.S.C. 154(b) by 304 days.

(21) Appl. No.: 15/728,194

(22) Filed: Oct. 9, 2017

(65) Prior Publication Data

US 2018/0045410 A1 Feb. 15, 2018

Related U.S. Application Data

(63) Continuation of application No. PCT/EP2016/055419, filed on Mar. 14, 2016.

(30) Foreign Application Priority Data

Apr. 8, 2015 (ES) ..... 201530394 U

(51) Int. Cl.
*F23N 5/10* (2006.01)

(52) U.S. Cl.
CPC .... *F23N 5/107* (2013.01); *F23N 2900/05101* (2013.01)

(58) Field of Classification Search
CPC ..... F23N 5/107; F23N 2900/05101; F16K 17/02; F16K 31/0675
See application file for complete search history.

(56) References Cited

U.S. PATENT DOCUMENTS 2,503,459 A 4/1950 Thornbery
2,886,050 A * 5/1959 Lamar ..... F23N 5/107 137/66

(Continued)

FOREIGN PATENT DOCUMENTS

EP 06190460 A1 10/1994
EP 1669673 A1 6/2006

(Continued)

OTHER PUBLICATIONS

International Search Report in corresponding PCT Application No. PCT/EP2016/055419, dated Jun. 21, 2016.

*Primary Examiner* — Eric Keasel
(74) *Attorney, Agent, or Firm* — Edell, Shapiro & Finnan, LLC

(57) ABSTRACT

Gas safety valve that includes a body having an inlet conduit and an outlet conduit. The body includes a housing in which a magnetic group is at least partially disposed. The magnetic group configured to regulate the opening or closing of a gas passage between the inlet conduit to the outlet conduit. The magnetic group includes an electromagnet, a support of the electromagnet and a bushing coupled to the support. The safety valve includes fixing means for fixing the bushing and the magnetic group to the body. The fixing means includes a fixing element having a cylindrical central part the free end of which is adapted to the geometry of the body retaining the fixing element against the body, and a flange extending radially towards the inside and retaining the bushing against the support.

25 Claims, 3 Drawing Sheets

(56) References Cited

U.S. PATENT DOCUMENTS

| | | | | |
|---|---|---|---|---|
| 2,991,792 | A * | 7/1961 | Ray | F23N 5/107 137/66 |
| 5,280,873 | A * | 1/1994 | Abrahamsen | H01F 7/081 251/129.15 |
| 5,785,511 | A * | 7/1998 | Shah | F23N 1/005 137/65 |
| 6,932,316 | B2 * | 8/2005 | Herbert | F16K 7/14 251/129.07 |
| 8,371,331 | B2 * | 2/2013 | Najmolhoda | F16K 31/062 137/596.17 |

FOREIGN PATENT DOCUMENTS

| | | | |
|---|---|---|---|
| ES | 1030940 | U | 11/1995 |
| WO | 2004088205 | A2 | 10/2004 |

* cited by examiner

SAFETY VALVE

CROSS-REFERENCE TO RELATED APPLICATIONS

This application relates to and claims the benefit and priority to International Application No. PCT/EP2016/055419, filed Mar. 14, 2016, which claims the benefit and priority to Spanish Utility Model Application No. U201530394, filed Apr. 8, 2015.

TECHNICAL FIELD

The present invention relates to a safety valve adapted to a gas combustion appliance. The invention particularly relates to a safety valve having fixing means optimized for fixing a magnetic group comprised in said safety valve to a body of said safety valve.

BACKGROUND

Safety valves adapted to a gas combustion appliance comprising a magnetic group opening or closing gas passage towards the burner are known in the state of the art. Generally, the magnetic group is connected to an external power supply source and/or to a thermocouple keeping the magnetic group energized as long as flame is detected in the burner, such that it is assured that the safety valve closes the gas passage towards the burner in the absence of flame.

Documents ES1024395U and ES1023978U both disclose a safety valve comprising a magnetic group and the connection thereof to a thermocouple. In both utility models, the magnetic group is housed in the body of the safety valve and fixed to said body through a threaded element. Said threaded element has two functions, on one hand, to assure sealing for which the tightening torque that must be applied by the operator is very high, and on the other hand, to be electrically conductive in order to act as a grounding terminal of the electromagnet.

SUMMARY OF THE DISCLOSURE

According to some implementations a safety valve is provided that comprises a body comprising an inlet conduit and an outlet conduit for the gas, a magnetic group housed at least partially in a housing of the body, opening or closing gas passage from the inlet conduit to the outlet conduit and comprising an electromagnet and a support of said electromagnet, and a bushing coupled to the support.

According to some implementations the safety valve further comprises fixing means for fixing the bushing and the magnetic group to the body. The fixing means comprises a fixing element comprising a cylindrical central part the free end of which is adapted to the geometry of the body retaining the fixing element against the body, and a flange extending radially towards the inside and retaining the bushing against the support. A safety valve with quick and optimized fixing means is thus obtained. On one hand, it is not necessary for the operator to apply a high tightening torque as occurs with the conventional threaded elements for obtaining the necessary sealing. The operator only has to fit the free end of the cylindrical central part to the body with the suitable tool, said operation being quicker and requiring less effort. Furthermore, the fixing element is a simple element which is much lighter in terms of material requirement and easier to manufacture compared to the conventional threaded element.

These and other advantages and features will become evident in view of the drawings and the detailed description.

DETAILED DESCRIPTION

Figure 1:
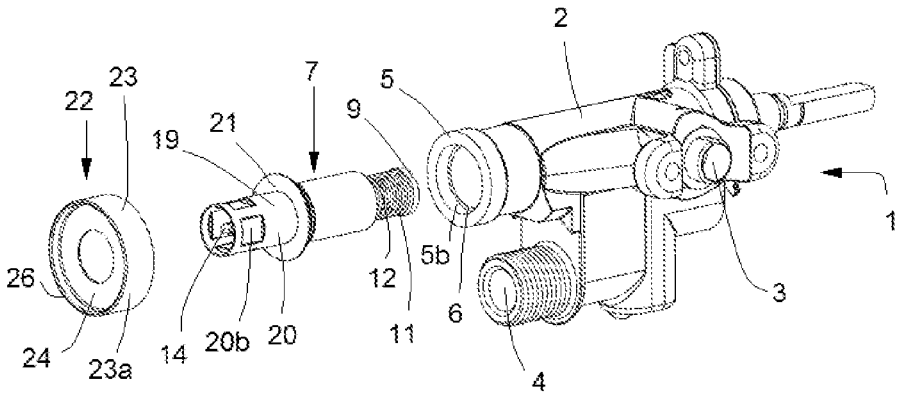
FIG. 1 shows an exploded view of a safety valve adapted to a gas combustion appliance according to one embodiment.
Figure 2:
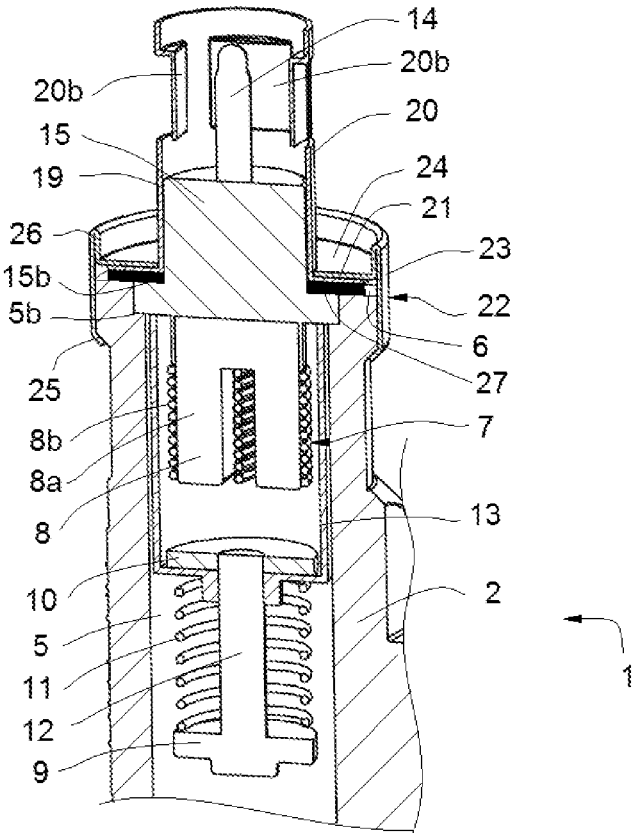
FIG. 2 is a partial sectioned view of the safety valve shown in FIG. 1.
Figure 3:
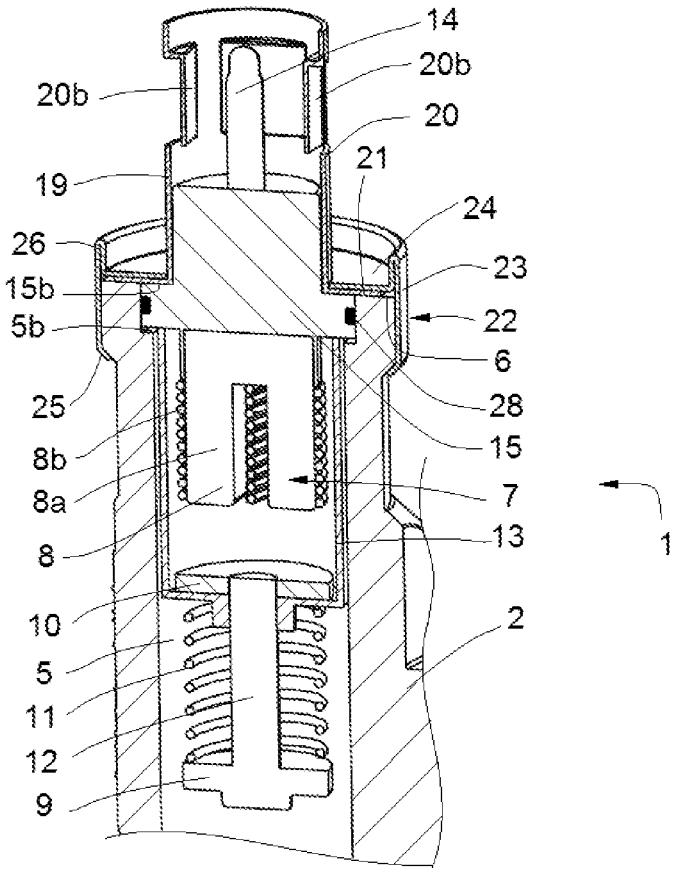
FIG. 3 is a partial sectioned view of another embodiment of the safety valve.

FIGS. 1 and 2 show a first embodiment of a safety valve 1 adapted to a gas combustion appliance allowing or blocking gas passage towards a burner of the gas combustion appliance (not depicted). FIG. 3 shows a second embodiment of the safety valve 1.

The safety valve 1 comprises a body 2 which in turn comprises an inlet conduit 3 for the gas, an outlet conduit 4 for the gas communicated with the burner and a magnetic group 7 which is at least partially housed in a housing 5 of the body 2. The housing 5 communicates the inlet conduit 3 with the outlet conduit 4 of the body 2.

The magnetic group 7 is known in the state of the art so it will not be described in detail. The magnetic group 7, shown in detail in FIGS. 2 and 3, comprises an electromagnet 8, a shutter 9 adapted for sealing against the body 2 the gas passage towards the outlet conduit 4, a moving frame 10 coupled to the shutter 9 and movable together with the shutter 9 between a safety valve opening position allowing gas passage towards the outlet conduit 4 (and therefore, towards the burner) and a safety valve closing position wherein the shutter 9 closes the gas passage towards the outlet conduit 4 (and therefore, towards the burner), and a spring 11 forcing the shutter 9 together with the moving frame 10 to return to the safety valve closing position when the electromagnet 8 is not energized. The shutter 9 is coupled to the moving frame 10 through a rod 12. The housing 5 is capable of being communicated with the outside to facilitate the insertion or removal of the magnetic group 7 from the housing.

Once the electromagnet 8 is energized either manually or through a specific power supply source, it is kept energized through a thermocouple (not depicted) as long as said thermocouple detects the presence of flame in the burner. In said position, the moving frame 10 is in contact with the electromagnet 8 (safety valve opening position) and the shutter 9 does not close the gas passage towards the outlet conduit 4. When the electromagnet 8 is no longer energized, the spring 11 acts on the shutter 9, moving it together with the moving frame 10 to the safety valve closing position, closing gas passage towards the outlet conduit 4.

The magnetic group 7 also comprises a support 15 of the electromagnet 8. The support 15 is made of an electrically conductive material, preferably a metallic material. The support 15 includes a housing (not shown) in which the electromagnet 8 is partially housed and supported. Furthermore, the electromagnet 8 comprises a core 8*a* made of a ferromagnetic material and a winding 8*b* comprising a first end connected to a grounding terminal and a second end connected to a phase terminal 14 of the magnetic group 7.

The magnetic group 7 further comprises a casing 13 enclosing therein the electromagnet 8 and the moving frame 10.

In the embodiments shown in FIGS. 1 to 3, the support 15 acts as a grounding terminal, the first end of the winding 8*b* being fixed to the support 15. The second end of the winding 8*b* in turn at least partially goes through the support 15, being fixed to the phase terminal 14

Furthermore, the body 2 of the safety valve 1 includes a recess 5*b* in the housing 5 such that the support 15 is supported on said recess 5*b* when the magnetic group 7 is housed in the housing 5 of the body 2.

The safety valve 1 further comprises a bushing 19 electrically connected to the grounding terminal 15 and arranged substantially concentric to the terminal phase 14 of the magnetic group 7.

The bushing 19, shown in detail in FIG. 1, has a cylindrical part 20 and an annular base 21 extending from an end of the cylindrical part 20. The bushing 19 is a metallic bushing, preferably a steel bushing. Said bushing 19 is coupled to the support 15. Furthermore, said bushing 19 includes protrusions 20*b* in the cylindrical part 20 extending radially towards the inside of the bushing 19, said protrusions 20*b* being adapted for guiding the insertion as well as assuring a good connection of the thermocouple (not depicted) with the bushing 19. The protrusions 20*b* are distributed radially equidistant from one another along the perimeter of the bushing 19. The bushing 19 is adapted for electrically connecting the grounding terminal of the magnetic group 7 with a grounding terminal of the thermocouple.

The safety valve 1 further comprises fixing means 22 for fixing the bushing 19 and the magnetic group 7 to the body 2. The fixing means 22 comprise a fixing element 23 comprising a cylindrical central part 23*a*, and an annular flange 24 extending radially towards the inside. The base 21 of the bushing 19 is held between the flange 24 of the fixing element 23 and the body 2. A free end 25 of the central part 23*a* is adapted to the outer geometry of the body 2 of the safety valve 1 retaining the fixing element 23 on the body. The fixing element 23 is made of a malleable and ductile metal material allowing it to easily adapt to the body 2. Said material is preferably aluminum.

Figure 4:
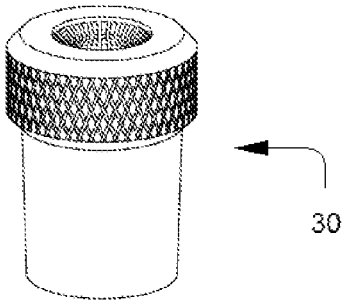
FIG. 4 shows a perspective view of an embodiment of a tool for crimping.

Once the magnetic group 7 is housed in the body 2 of the safety valve 1 and the bushing 19 is inserted in the magnetic group 7, the fixing element 23 is placed on the bushing 19 such that the annular flange 24 of the fixing element 23 presses on the base 21 of the bushing 19 against the body 2 of the valve 1 and the magnetic group 7, and by means of a suitable tool (such as that shown in FIG. 4) the free end 25 of the fixing element 23 is crimped to the body 2 of the valve 1 such that the fixing element 23 remains fixed to the body 2 of the valve 1. The tool 30 shown in FIG. 4 is introduced axially, outside the fixing element 23 such that the geometry thereof forces the free end 25 of the fixing element 23 to fit to the body 2 of the valve 1.

The safety valve 1 further comprises release means 26 for releasing the magnetic group 7 with respect to the body 2. The release means 26 is integrated in the fixing element 23. In the embodiments shown in the drawings, the release means 26 comprises an annular projection between the central part 23*a* and the annular flange 24 of the fixing element 23. Said annular projection extends orthogonal to the annular flange 24, continuous to said annular flange 24 and to the central part 23*a*. The release means 26 allows the operator to release the magnetic group 7 and/or the bushing 19 from the body 2 easily. Therefore, when the operator has to carry out maintenance actions, such as changing the magnetic group 7 and/or the bushing 19, he/she press on the release means 26 radially with a suitable tool (such as, for example, suitable pliers) until releasing the free end 25 of the fixing element 23 from the body 2. He/she then removes the fixing element 23, it being possible to remove the magnetic group 7 and/or the bushing 19 from the body 2.

Although the fixing element 23 and the bushing 19 are independent parts in the embodiments that have been shown, in other embodiments that are not shown in the drawings, the fixing element 23 and the bushing 19 can form a single part, i.e., both elements can be made of a single part. Taking into account that the bushing 19 is made of a hard metal and the fixing element 23 is made of a ductile and malleable metal, the single part can be made of two different materials to obtain the same effect.

The safety valve 1 further comprises sealing means 27 and 28 preventing the gas from coming out from the housing 5 of the body 2 towards the outside. In the first embodiment shown in FIGS. 1 and 2, the sealing means 27 is arranged between a transverse surface 6 of the body 2 and the bushing 19. Said transverse surface demarcates the recess 5*b* in the housing 5 of the body 2. Said sealing means 27 comprises a gasket held between the transverse surface 6 of the body 2 and the base 21 of the bushing 19. The gasket is supported on the transverse surface 6 of the body 2 and on a transverse surface 15*b* of the support 15. Both transverse surfaces 6 and 15*b* are aligned with one another when the magnetic group 7 is housed in the housing 5 of the body 2.

In the second embodiment shown in FIG. 3, the sealing means 28 comprises an O-ring gasket which is housed in the support 15 and closes against the recess 5*b* in the housing 5 of the body 2. In this second embodiment, the base 21 of the bushing 19 is supported directly on the respective transverse surfaces 6 and 15*b* of the body 2 and of the support 15. The rest of the technical features of this second embodiment are the same as those of the first embodiment.

What is claimed is:

1. A safety valve configured for permitting or preventing a gas flow to a gas combustion appliance, the safety valve comprising:

a valve body having a gas inlet conduit, a gas outlet conduit;

a valve body housing formed by the valve body that communicates the inlet conduit with the outlet conduit;

a magnetic group at least partially housed in the valve body housing, the magnetic group comprising:

a shutter configured to control the flow of gas between the gas inlet conduit and the gas outlet conduit;

an electromagnet that includes a core and a winding wound about the core, the core having a first end and a second end;

a support in contact with the second end of the core a moving frame coupled to the shutter, the moving frame configured to magnetically interact with the electromagnet to be moved from a first axial position to a second axial position, the first axial position corresponding to a closed position of the shutter to prevent gas flow between the gas inlet and outlet conduits, the second axial position corresponding to an open position of the shutter to permit gas flow between the gas inlet and outlet conduits;

a bushing in which the support is at least partially housed, the bushing having base;

a fixing element that comprises central part and a flange extending radially from the central part, the base of the bushing being held between the flange of the fixing element and the valve body, the fixing element being fixed to the valve body without the use of threads to secure the magnetic group inside the valve body housing, the fixing element being fixed to the valve body by a free end portion that extends from the flange, the free end portion being made of malleable material that extends across and conforms to a bend on an outer surface of the valve body.

2. The safety valve according to claim 1, wherein the magnetic group further comprises a casing located inside the valve body, the shutter residing outside the casing, the moving frame and first end of the core residing inside the casing.

3. The safety valve according to claim 2, wherein the support is at least partially enclosed by the casing.

4. The safety valve according to claim 1, wherein the support is made of an electrically conductive material.

5. The safety valve according to claim 4, wherein first end of the core resides inside the support.

6. The safety valve according to claim 4, wherein the support is at least partially enclosed by the casing.

7. The safety valve according to claim 1, wherein the base of the bushing is an annular base and the flange of the fixing element is an annular flange.

8. The safety valve according to claim 1, further comprising a gasket disposed between the flange of the bushing and a transverse surface of the valve body.

9. The safety valve according to claim 1, further comprising a sealing O-ring disposed in a recess that circumscribes the support, the sealing O-ring residing between the support and the valve body.

10. The safety valve according to claim 1, wherein the bushing has a cylindrical part that projects outside the valve body, the base extending radially from the cylindrical part, at least a portion of the support residing inside the cylindrical part.

11. The safety valve according to claim 1, wherein the bushing includes a plurality of protrusions in the cylindrical part extending radially towards the inside of the bushing.

12. The safety valve according to claim 1, wherein the fixing element includes release means for releasing the magnetic group with respect to the body integrated in the fixing element.

13. The safety valve according to claim 12, wherein the release means for releasing the magnetic group comprises an annular projection between the central part and the flange of the fixing element, extending orthogonal to the flange.

14. The safety valve according to claim 1, wherein the fixing element and the bushing are integrated in a single part.

15. The safety valve according to claim 1, wherein the fixing element is made of an electrically non-conductive material.

16. The safety valve according to claim 15, wherein the electrically non-conductive material is aluminum.

17. A safety valve configured for permitting or preventing a gas flow to a gas combustion appliance, the safety valve comprising:

a valve body having a gas inlet conduit, a gas outlet conduit;

a valve body housing formed by the valve body that communicates the inlet conduit with the outlet conduit;

a magnetic group at least partially housed in the valve body housing, the magnetic group comprising:

a casing located inside the valve body housing;

a shutter configured to control the flow of gas between the gas inlet conduit and the gas outlet conduit, the shutter residing outside the casing;

an electromagnet that includes a core and a winding wound about the core, the core having a first end and a second end, the first end of the core residing inside the casing;

an electrically conductive support being at least partially enclosed by the casing, the electrically conductive support having a housing in which the second end of the core resides;

a moving frame coupled to the shutter, the moving frame configured to magnetically interact with the electromagnet to be moved from a first axial position to a second axial position, the first axial position corresponding to a closed position of the shutter to prevent gas flow between the gas inlet and outlet conduits, the second axial position corresponding to an open position of the shutter to permit gas flow between the gas inlet and outlet conduits;

a bushing in which the electrically conductive support is at least partially housed, the bushing having a base;

a fixing element that comprises a cylindrical central part and a flange extending radially from the cylindrical central part, the base of the bushing being held between the flange of the fixing element and the valve body, the fixing element being fixed to the valve body without the use of threads to secure the magnetic group inside the valve body housing, the fixing element having a free end portion that extends from the flange, the free end portion being made of malleable material that extends across and conforms to a bend on an outer surface of the valve body.

18. The safety valve according to claim 17, wherein the base of the bushing is an annular base and the flange of the fixing element is an annular flange.

19. The safety valve according to claim 17, further comprising a gasket disposed between the flange of the bushing and a transverse surface of the valve body.

20. The safety valve according to claim 17, further comprising a sealing O-ring disposed in a recess that circumscribes the electrically conductive support, the sealing O-ring residing between the support and the valve body.

21. The safety valve according to claim 17, wherein the bushing has a cylindrical part that projects outside the valve body, the base extending radially from the cylindrical part, at least a portion of the electrically conductive support residing inside the cylindrical part.

22. The safety valve according to claim 17, wherein the fixing element includes release means for releasing the magnetic group, the release means comprises an annular projection between the central part and the flange of the fixing element, extending orthogonal to the flange.

23. The safety valve according to claim 17, wherein the fixing element and the bushing are integrated in a single part.

24. The safety valve according to claim 17, wherein the fixing element is made of an electrically non-conductive material.

25. The safety valve according to claim 24, wherein the electrically non-conductive material is aluminum.

* * * * *